US009296966B2

(12) United States Patent
Mak

(10) Patent No.: US 9,296,966 B2
(45) Date of Patent: Mar. 29, 2016

(54) PROPANE RECOVERY METHODS AND CONFIGURATIONS

(75) Inventor: John Mak, Santa Ana, CA (US)

(73) Assignee: Fluor Technologies Corporation, Sugar Land, TX (US)

( * ) Notice: Subject to any disclaimer, the term of this patent is extended or adjusted under 35 U.S.C. 154(b) by 899 days.

(21) Appl. No.: 12/300,376

(22) PCT Filed: Jul. 6, 2007

(86) PCT No.: PCT/US2007/015552
§ 371 (c)(1),
(2), (4) Date: Mar. 13, 2009

(87) PCT Pub. No.: WO2008/005518
PCT Pub. Date: Jan. 10, 2008

(65) Prior Publication Data

US 2009/0308101 A1 Dec. 17, 2009

Related U.S. Application Data

(60) Provisional application No. 60/819,314, filed on Jul. 6, 2006.

(51) Int. Cl.

| | |
|---|---|
| ***F25J 1/00*** | (2006.01) |
| ***F25J 3/00*** | (2006.01) |
| ***C10L 3/12*** | (2006.01) |
| ***F25J 3/02*** | (2006.01) |

(52) U.S. Cl.
CPC ..... *C10L 3/12* (2013.01); *F25J 3/0209* (2013.01); *F25J 3/0233* (2013.01); *F25J 3/0242* (2013.01); *F25J 2200/02* (2013.01); *F25J 2200/74* (2013.01); *F25J 2205/04* (2013.01); *F25J 2240/02* (2013.01); *F25J 2270/02* (2013.01); *F25J 2270/12* (2013.01); *F25J 2270/60* (2013.01)

(58) Field of Classification Search
CPC .... F25J 2200/74; F25J 2205/04; F25J 3/0242
USPC ..... 62/11, 12, 13, 17, 18, 19, 20, 23
See application file for complete search history.

(56) References Cited

U.S. PATENT DOCUMENTS

| | | | | |
|---|---|---|---|---|
| 4,854,955 | A * | 8/1989 | Campbell et al. | 62/621 |
| 6,021,647 | A * | 2/2000 | Ameringer et al. | 62/631 |
| 6,516,631 | B1 * | 2/2003 | Trebble | 62/630 |
| 6,712,880 | B2 * | 3/2004 | Foglietta et al. | 95/184 |
| 6,931,889 | B1 | 8/2005 | Foglietta et al. | |
| 2001/0008073 | A1 * | 7/2001 | Finn et al. | 62/621 |

(Continued)

FOREIGN PATENT DOCUMENTS

| | | | | |
|---|---|---|---|---|
| WO | 97/16505 | A1 | 5/1997 | |
| WO | WO 9716505 | A1 * | 5/1997 | B01D 53/1418 |

(Continued)

*Primary Examiner* — M. Alexandra Elve
*Assistant Examiner* — Henry Crenshaw
(74) *Attorney, Agent, or Firm* — Conley Rose, P.C.; Kristin Jordan Harkins

(57) ABSTRACT

High-pressure feed gas is chilled and expanded to condense a portion of the feed gas into a C2+ enriched liquid phase and a C2+ depleted vapor phase. The liquid phase is expanded to provide additional cooling for the feed gas and deethanizer reflux prior to being fed to the deethanizer while the vapor is combined with residue gas of a deethanizer.

15 Claims, 4 Drawing Sheets

(56) References Cited

U.S. PATENT DOCUMENTS

| | | | | |
|---|---|---|---|---|
| 2002/0166336 | A1* | 11/2002 | Wilkinson et al. | 62/620 |
| 2004/0250569 | A1* | 12/2004 | Mak | 62/625 |
| 2006/0090508 | A1* | 5/2006 | Howard | 62/613 |

FOREIGN PATENT DOCUMENTS

| | | | | | |
|---|---|---|---|---|---|
| WO | 98/47839 | A1 | | 10/1998 | |
| WO | WO 9847839 | A1 | * | 10/1998 | C10G 5/06 |
| WO | 99/30093 | A2 | | 6/1999 | |
| WO | WO 9930093 | A2 | * | 6/1999 | F25J 3/0209 |
| WO | 02/14763 | A1 | | 2/2002 | |
| WO | WO 0214763 | A1 | * | 2/2002 | F25J 3/0209 |
| WO | 03/100334 | A1 | | 12/2003 | |
| WO | WO 03100334 | A1 | * | 12/2003 | F25J 3/0209 |
| WO | 2005/045538 | A1 | | 5/2005 | |
| WO | WO 2005045538 | A1 | * | 5/2005 | G05B 15/02 |

* cited by examiner

PROPANE RECOVERY METHODS AND CONFIGURATIONS

This application claims priority to our U.S. provisional patent application with the Ser. No. 60/819,314, which was filed Jul. 6, 2006.

FIELD OF THE INVENTION

The field of the invention is gas processing, and especially natural gas processing for propane recovery.

BACKGROUND OF THE INVENTION

Various expansion processes are known for natural gas liquids (NGL) recovery, and especially for the recovery of propane from high pressure feed gas. Most conventional high propane recovery processes are complex in design, typically requiring propane refrigeration and turbo expanders for feed gas chilling, column reflux, and at least two fractionation columns (e.g., absorber, demethanizer, and/or deethanizer). While such known processes can achieve over 95% propane recovery, cost and energy consumption are generally very high. Additionally, pipeline operators may desire to reserve some propane in the residue gas to improve the heating value of the pipeline gas, and therefore not always opt for high propane recovery. In such cases, medium propane recovery processes (e.g., propane recoveries of 50% to 80%) are more economical.

To reduce at least some of the capital and/or operating expenses, propane refrigeration requirements can be reduced by cooling the feed gas in a demethanizer overhead exchanger and/or one or more side reboilers to partially liquefy the feed gas. The so formed liquid phase of the feed gas is then separated from the vapor phase, which is typically split in two streams. One stream is further chilled and fed to the upper section of the demethanizer as reflux while the other stream is letdown in pressure in a turbo-expander and fed to the mid section of the demethanizer. For propane recovery, a second column (e.g., deethanizer) is then used that receives and separates the demethanizer bottoms into an ethane overhead and the desirable propane product. Such configurations typically require costly processing equipment and considerable horsepower to compress the residue gas from the demethanizer to pipeline pressure, thereby rendering such plants often uneconomical.

Alternatively, high propane recovery can be achieved by recovering propane content in the residue gas from the demethanizer column by operating the demethanizer at a relatively low temperature, or by adding an additional rectification stage. Lower temperatures can be achieved by further lowering the demethanizer pressure at the expense of even higher residue gas compression horsepower. On the other hand, where a relatively high feed gas pressure is present, the demethanizer column pressure could theoretically be increased to thereby reduce residue gas compression horsepower and thus lower the overall energy consumption. However, the increase in demethanizer pressure is typically limited to between 450 psig to 550 psig as higher column pressure will decrease the relative volatilities between the methane and ethane components, making fractionation difficult, if not even impossible.

Exemplary NGL recovery plants with a turbo-expander, feed gas chiller, separators, and a refluxed demethanizer are described, in U.S. Pat. No. 4,854,955 to Campbell et al. Here, a configuration is employed for NGL recovery with turbo-expansion, in which the demethanizer column overhead vapor is cooled and condensed by an overhead exchanger using refrigeration generated from feed gas chilling. Such additional cooling step condenses most of the propane and heavier components from the demethanizer overhead, which is later recovered in a separator and returned to the column as reflux. The demethanizer bottoms is fractionated in a deethanizer, which is refluxed with propane refrigeration. Unfortunately, while such processing steps significantly improve the propane recovery to over 95%, the energy consumption is relatively high. Similar configurations are shown in WO 99/30093, WO97/16505, WO 2005/045338 A1, WO 02/14763 A1, and WO 03/100334 A1 with similar difficulties.

Thus, while numerous attempts have been made to improve the efficiency and economy of processes for separating and recovering propane and heavier natural gas liquids from natural gas and other sources, all or almost all of them suffer from one or more disadvantages. Most significantly, heretofore known configurations and methods are costly (operating and/or capital cost) and often complex and energy intensive. In addition, conventional methods of demethanization typically fail to exploit the economic benefit of high feed gas pressure. Therefore, there is still a need to provide improved methods and configurations for natural gas liquids recovery, especially where the feed gas pressure is relatively high.

SUMMARY OF THE INVENTION

The present invention is directed to plant configurations and methods in which high-pressure feed gas is chilled and expanded to low temperatures to produce a C2+ depleted vapor and a C2+ enriched liquid, wherein the liquid is further expanded to generate additional cooling. The C2+ depleted vapor is combined with the residue gas to form the final product and deethanizer one or more side reboilers further assist in cooling the feed gas. Therefore, in such configurations and methods external refrigeration is significantly reduced, if not even entirely eliminated and cost-intensive equipment (e.g., turboexpander, demethanizer) is not required.

In one aspect of the inventive subject matter, a method of processing a gas stream will thus include a step of cooling and expanding a fed gas to a temperature and pressure effective to condense a portion of the feed gas into a C2+ enriched liquid phase and a C2+ depleted vapor phase. In another step, the vapor phase is separated from the liquid phase in a high-pressure separator, and the vapor phase is combined with a portion of a deethanizer overhead product. In yet another step, the liquid phase is expended to provide cooling for the feed gas and/or a deethanizer overhead product, and the expanded liquid phase is fed to a deethanizer to thereby produce the deethanizer overhead product and a C3+ bottom product.

Consequently, in another aspect of the inventive subject matter, a gas processing plant will include a first heat exchanger and a first expansion device that together cool and expand a high-pressure feed gas to a temperature and pressure effective to condense a portion of the feed gas into a C2+ enriched liquid phase and a C2+ depleted vapor phase. A high-pressure separator is fluidly coupled to the first expansion device and separates the cooled and expanded feed gas into the vapor phase and the liquid phase. Contemplated plants further include a connection between the high-pressure separator and the deethanizer to carry a portion of a deethanizer overhead product, and to allow combination of the vapor phase with the portion of the deethanizer overhead product. A second expansion device is configured to receive and expand the liquid phase and provides the expanded liquid phase to the first heat exchanger and/or a second heat exchanger, wherein the first and/or second heat exchangers provide cooling for the feed gas and/or the deethanizer overhead product, and a deethanizer receives the expanded liquid phase to produce the deethanizer overhead product and a C3+ bottom product.

In especially preferred aspects, the feed gas has a pressure of at least 1000 psig, and the feed gas is cooled and expanded to a pressure of between about 500 to about 700 psig and a temperature between about −30° F. to about −60° F. Where desirable, the vapor portion and liquid portion may be separately expanded (e.g., vapor in turbo expander and liquid in JT valve). In further preferred aspects, cooling of the feed gas and/or the deethanizer overhead product is performed in a single heat exchanger or two separate heat exchangers. Moreover, the deethanizer overhead product may be cooled and separated to thereby form a reflux to the deethanizer and the portion of the deethanizer overhead product, and refrigeration content of the vapor phase may be used to provide reflux cooling duty and/or feed gas cooling duty. Most preferably, the reflux has a temperature between −30° F. to −60° F., and the deethanizer is operated at a pressure of between about 500-700 psig.

Various objects, features, aspects and advantages of the present invention will become more apparent from the following detailed description of preferred embodiments of the invention, along with the accompanying drawing.

DETAILED DESCRIPTION

The inventor has discovered that a high pressure feed gas (e.g. 1000 psig and higher) can be processed in configurations and methods that employ feed gas chilling and expansion of the chilled feed gas to reduce the temperature to a degree sufficient for condensation of a portion of the feed gas into a C2+ enriched liquid phase and a C2+ depleted vapor phase. A downstream high-pressure separator separates the vapor phase from the liquid phase and the vapor phase is combined with the residue gas while the liquid phase is further expanded to provide extra cooling to the feed gas and/or reflux prior to being fed to the deethanizer.

It should be especially noted that the residue gas compression is substantially reduced in most of the configurations and methods contemplated herein as the bulk (e.g., at least 80%, more typically at least 90%, and most typically at least 95%) of the methane is removed in the high pressure separator and the separation column is a deethanizer operating at about 500 psig to about 700 psig instead of a typical demethanizer operating at about 450 psig. Viewed from a different perspective, it should be appreciated that a conventional demethanizer is not required and energy consumption is therefore lower than in heretofore known NGL processes. Most typically, contemplated plant configurations and methods allow for propane recovery in the range of between about 50% to 80% (relative to the total propane content in the feed gas), and the specific energy consumption (i.e., kW power per ton of propane product) is substantially lower than for any heretofore known NGL process. Moreover, it should be appreciated that most of the cooling requirement of the feed gas and the deethanizer reflux is provided by expansion of the feed gas, the high-pressure separator vapor, and the liquid using Joule-Thomson valves.

Figure 1:
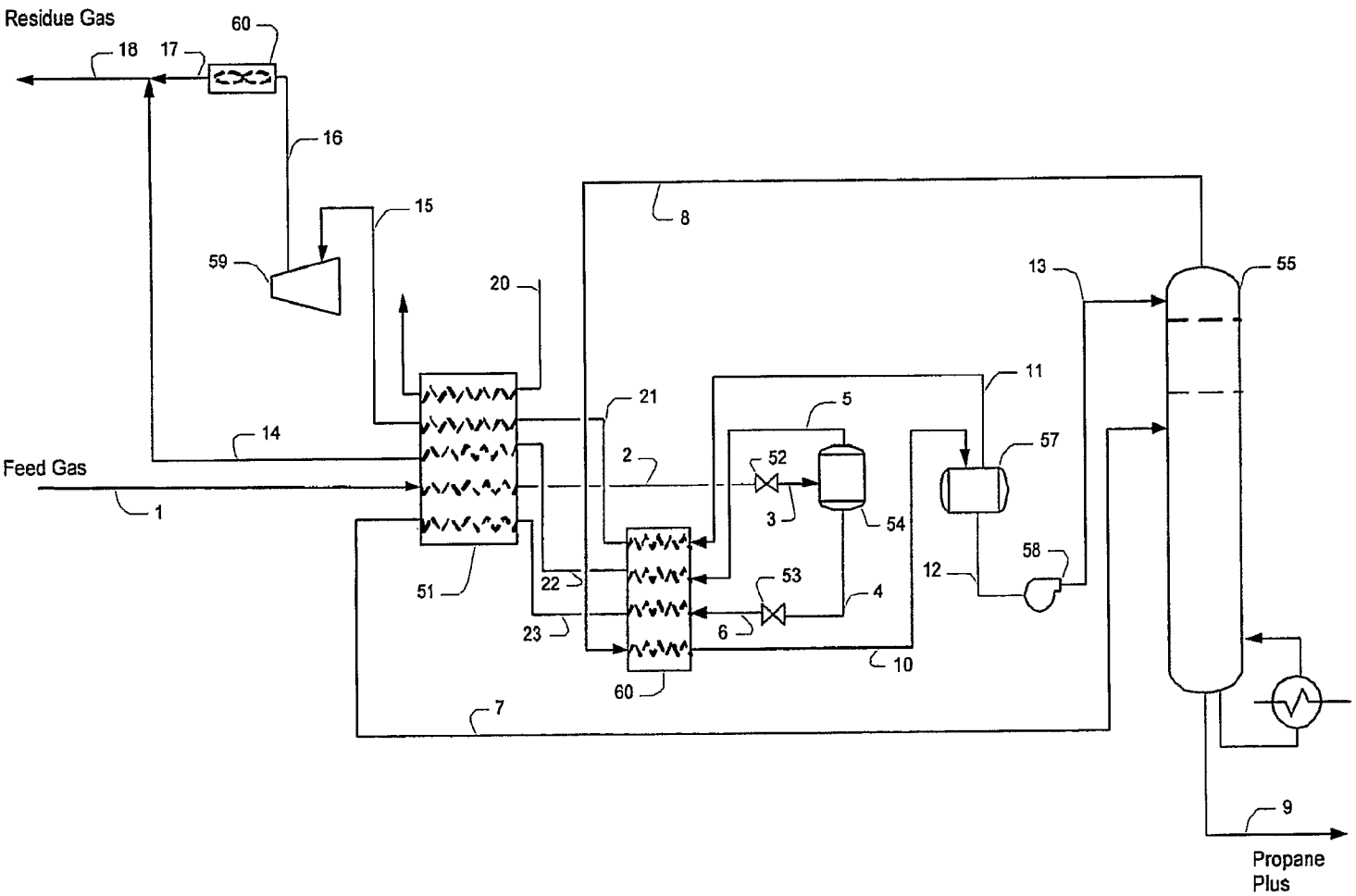
FIG. 1 is a schematic diagram of one exemplary propane recovery configuration according to the inventive subject matter.

In one preferred aspect of the inventive subject matter, an exemplary plant as depicted in FIG. 1, chilling and expansion is adjusted to provide cooling for both the feed gas and the deethanizer reflux. Most typically, expansion and chilling are set such that the deethanizer reflux temperature is preferably maintained at −40 to −70° F. (for rectification of the propane and heavier components) to achieve a desired propane recovery, which is typically in the range of between about 50% to 80%. It should be especially noted that in such configurations a turbo expander, a demethanizer, one or more demethanizer side reboilers, and the feed chiller system of currently known plants and methods can be eliminated, which significantly reduces the NGL plant costs.

With further reference to FIG. 1, the dry feed gas stream 1, typically at about 110° F. and about 1000 psig is chilled in exchanger 51 to about −20° F. to about −50° F., forming stream 2 using refrigeration content of (1) high-pressure separator vapor stream 22, (2) deethanizer reflux separator vapor stream 21, and (3) high-pressure separator liquid let-down stream 23. As needed, propane refrigeration 20 can be used to achieve the desired feed temperature. Stream 2 is expanded in the Joule-Thomson valve 52 to about 500 to about 700 psig, forming stream 3, typically at about −30° F. to about −60° F. The so obtained cooled two phase stream is separated in high-pressure separator 54 into a vapor stream 5 and a liquid stream 4. Stream 4 is let down in pressure to about 250 psig to about 400 psig via Joule-Thomson valve 53, forming stream 6, typically at about −40° F. to about −75° F., which is heat exchanged with the deethanizer overhead stream 8 providing cooling to the deethanizer condenser 60. Stream 6 is heated to about −30° F. to about −60° F. in exchanger 60, forming stream 23, which is further heated in exchanger 51 forming stream 7, typically at about 20° F. to about 90° F. Deethanizer reflux duty is also supplied by the high-pressure separator vapor stream 5 and deethanizer reflux separator vapor stream 11.

The heated liquid stream 7 is then fed to the mid section of the deethanizer 55 that produces an ethane rich overhead stream 8 and a propane and heavier (C3+) bottoms stream 9. The deethanizer overhead vapor 8 is cooled in the reflux condenser 60 by streams previously described. The chilled deethanizer overhead stream 10 from the reflux condenser 60 is partially condensed, separated in separator 57, and the methane and ethane rich liquid 12 is pumped by reflux pump 58 forming reflux stream 13 to the deethanizer. The deethanizer bottoms stream 9 containing the C3+ hydrocarbons is withdrawn as commodity. Deethanizer reflux drum vapor stream 15 exiting feed chiller 51 is compressed by compressor 59, forming stream 16, typically at about 600 psig to about 800 psig, cooled by air cooler 60 forming stream 17, which is mixed with the residue vapor stream 14 from exchanger 51, forming the sales gas stream 18.

As used herein, the term "about" in conjunction with a numeral refers to a range of that numeral starting from 20% below the absolute of the numeral to 20% above the absolute of the numeral, inclusive. For example, the term "about −100° F." refers to a range of −80° F. to −120° F., and the term "about 1000 psig" refers to a range of 800 psig to 1200 psig. While it is preferred that stream 2 is expanded in a Joule-Thomson valve, alternative known expansion devices are also considered suitable for use herein and include power recovery turbines and expansion nozzles. The term "C2+ enriched" liquid, vapor, or other fraction as used herein means that the liquid, vapor, or other fraction has a higher molar fraction of C2, C3, and/or heavier components than the liquid, vapor, or other fraction from which the C2+ enriched liquid, vapor, or other fraction is derived. Similarly, the term "C2+ depleted" liquid, vapor, or other fraction as used herein means that the liquid, vapor, or other fraction has a lower molar fraction of C2, C3, and/or heavier components than the liquid, vapor, or other fraction from which the C2+ depleted liquid, vapor, or other fraction is derived. The term "C2+" as used herein refers to ethane and heavier hydrocarbons.

Figure 2:
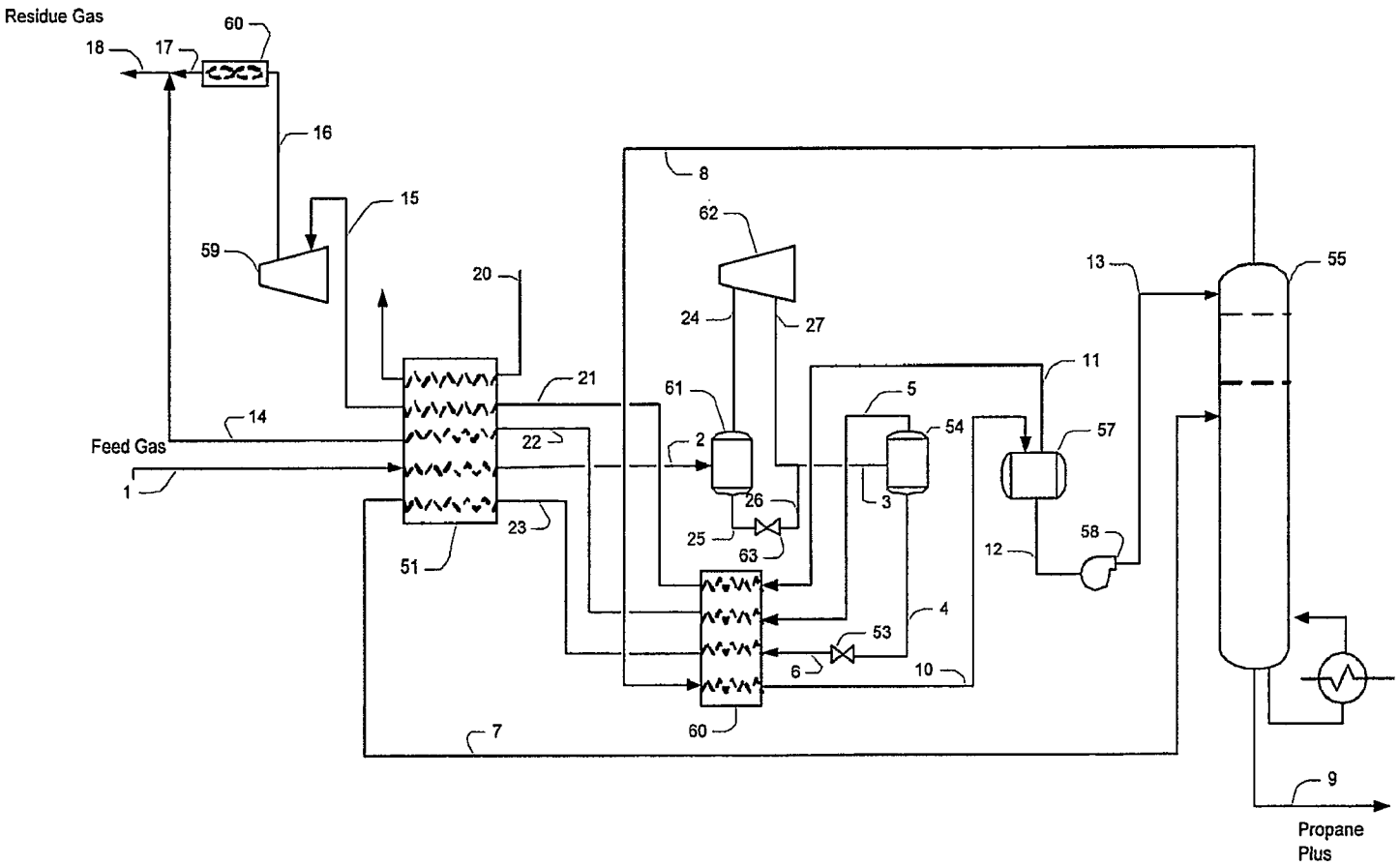
FIG. 2 is a schematic diagram of another exemplary propane recovery configuration according to the inventive subject matter.

FIG. 2 shows an alternative configuration in which the expansion of the cooled feed gas is performed in two separate devices. Here, the cooled feed gas is first separated into a vapor phase and a liquid phase, wherein the vapor phase is expanded in a turbo expander to reduce, or even eliminate the power requirements of the residue gas compression horsepower and refrigeration (which in turn reduces energy consumption and improves propane recovery) of the plant. The liquid stream is reduced in pressure via JT valve (or other pressure reduction device for liquids such as an expansion turbine). More specifically, and with further reference to FIG. 2, the chilled vapor stream 2 from chiller exchanger 51 is separated in feed high-pressure separator 61 into a liquid stream 25 and a vapor stream 24. The vapor stream is expanded to about 500 psig to about 700 psig using turbo expander 62 forming stream 27, typically at about −40° F. to about −80° F., while liquid stream 25 is expanded in JT valve 63 to form stream 26. Streams 26 and 27 are combined to form two phase stream 3 that is then sent to the high-pressure separator 54. As used herein, the term "high-pressure separator" refers to a separator that is configured to separate a vapor phase from a liquid phase at a pressure of above about 500 psig. The operation and interconnection of the other components in FIG. 2 is substantially the same to the configuration of FIG. 1 above, and with respect to the remaining components and numbering, the same numerals and considerations as in FIG. 1 above apply.

Figure 3:
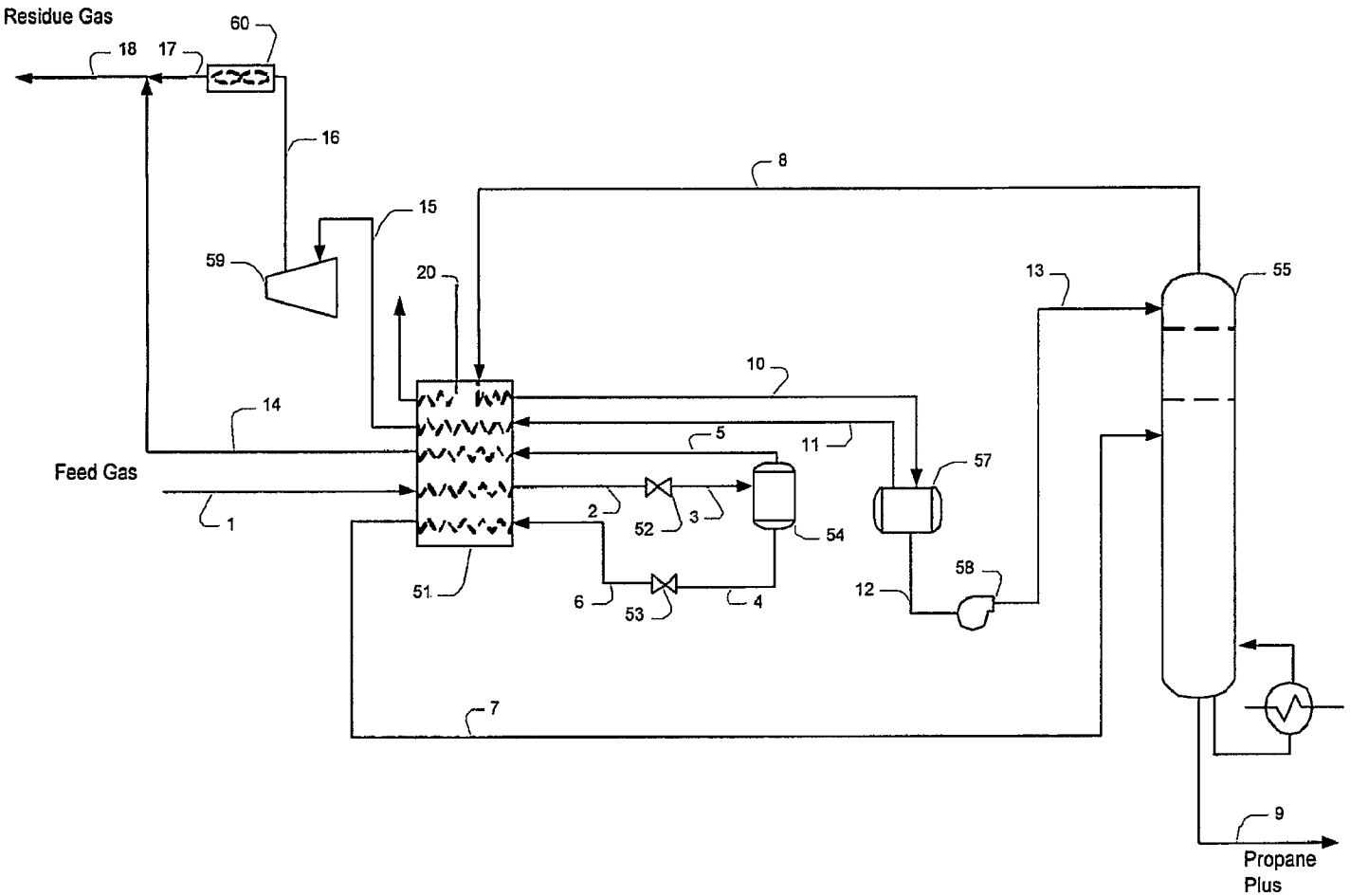
FIG. 3 is a schematic diagram of a further exemplary propane recovery configuration according to the inventive subject matter.

FIG. 3 shows yet another alternative configuration in which the feed chiller exchanger 51 and the deethanizer reflux condenser are integrated into a single core heat exchanger for an even more cost effective design (such integration may also be adopted to the turboexpander configurations of FIG. 2). The operation and interconnection of the other components in FIG. 3 is substantially the same to the configuration of FIG. 1 above, and with respect to the remaining components and numbering, the same numerals and considerations as in FIG. 1 above apply.

Figure 4:
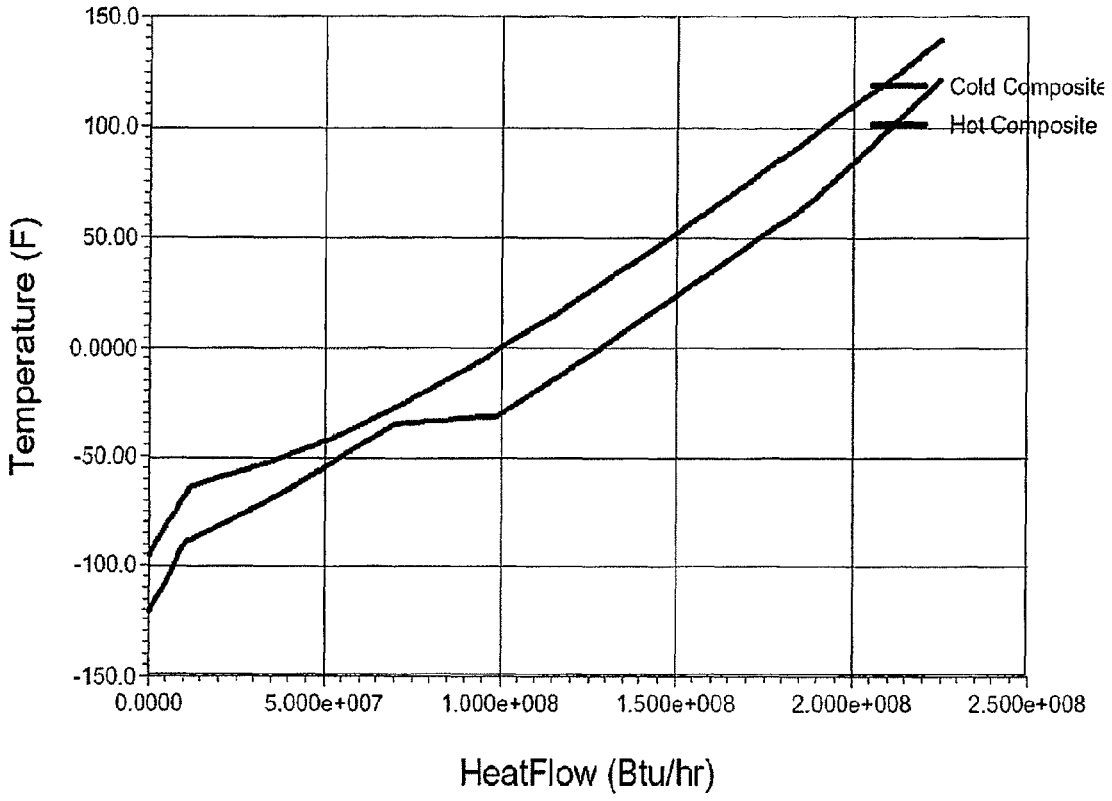
FIG. 4 shows the heat composite curves of the exemplary propane recovery configuration according to the inventive subject matter.

The high efficiency of the contemplated process is illustrated in FIG. 4, which shows the heat exchange composite curves of the feed chiller 51 and reflux condenser 60 (upper curve is hot composite curve, lower curve is cold composite curve). Here, the cooling streams include the high-pressure separator vapor stream 5, the deethanizer reflux separator vapor stream 11, the high-pressure separator liquid letdown stream 6, and propane refrigerant stream 20. The heating streams include the feed gas stream 1 and the deethanizer overhead vapor stream 8. As can be seen in FIG. 4, the temperature approaches between the cold and hot composite curves are between 4° F. to 15° F. and the curves are almost parallel, illustrating minimum work loss and high efficiency of this process.

The material balance of a typical feed gas (composition see stream 1; all numbers expressed in mol %) using the exemplary configuration of FIG. 1 is shown in Table 1 below, listing the compositions of the key streams with numbers as in FIG. 1. Propane recovery of 75% can be achieved with a very low specific power consumption (kW power/ton propane product).

| | 1 | 5 | 4 | 8 | 9 | 18 |
|---|---|---|---|---|---|---|
| CO2 | 1.78 | 1.52 | 3.46 | 4.43 | 0.98 | 1.81 |
| Nitrogen | 0.51 | 0.57 | 0.10 | 0.15 | 0.00 | 0.53 |
| Methane | 91.30 | 95.73 | 62.82 | 86.42 | 2.00 | 94.79 |
| Ethane | 2.54 | 1.66 | 8.16 | 8.79 | 6.56 | 2.38 |
| Propane | 1.47 | 0.40 | 8.35 | 0.22 | 29.29 | 0.38 |
| i-Butane | 0.38 | 0.04 | 2.53 | 0.00 | 9.06 | 0.04 |
| n-Butane | 0.74 | 0.06 | 5.13 | 0.00 | 18.35 | 0.05 |
| i-Pentane | 0.27 | 0.01 | 1.97 | 0.00 | 7.06 | 0.01 |
| n-Pentane | 1.02 | 0.01 | 7.46 | 0.00 | 26.70 | 0.01 |

Consequently, it should be appreciated that propane recovery can be achieved from numerous feed gases, and especially natural gas having a pressure of greater than 700 psig in configurations and methods in which the feed gas is first cooled via heat exchange and further cooled via expansion, wherein the feed gas is cooled and expanded such that C2+ components substantially completely (e.g., at least 20%, more typically at least 50%, most typically at least 75%) condense. The so obtained mixed phase stream is then separated at high pressure (typically at least about 500 psig, more typically about 600-700 psig) to provide a C3+ depleted vapor and a C3+ enriched liquid. Most preferably, both the vapor and liquid are then heat exchanged against the feed gas and deethanizer overhead. The warmed C3+ depleted vapor is then combined with the residue gas while the warmed C3+ enriched liquid is fed to the deethanizer as deethanizer feed. It should thus be especially appreciated that by use of (1) high pressure separation of the cooled feed gas and (2) expansion of the high pressure liquid to reflux a deethanizer operating at lower pressure, recompression of processed feed gas is substantially eliminated or reduced, 50% to 80% propane recovery can be achieved, while refrigeration requirements are almost entirely provided by expansion of the feed gas.

Thus, specific embodiments and applications of configurations and methods related to propane recovery have been disclosed. It should be apparent, however, to those skilled in the art that many more modifications besides those already described are possible without departing from the inventive concepts herein. The inventive subject matter, therefore, is not to be restricted except in the spirit of the present disclosure. Moreover, in interpreting the specification and contemplated claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Furthermore, where a definition or use of a term in a reference, which is incorporated by reference herein is inconsistent or contrary to the definition of that term provided herein, the definition of that term provided herein applies and the definition of that term in the reference does not apply.

What is claimed is:

1. A method of processing a gas stream, comprising:

cooling and expanding a feed gas having a pressure of at least 1000 psig to a temperature and pressure effective to condense a portion of the feed gas, thereby forming a two-phase stream comprising feed gas liquid and a feed gas vapor;

feeding the two-phase stream into a high-pressure phase separator, and separating in the high-pressure separator the two-phase stream into the feed gas liquid and the feed gas vapor at a pressure between 600-700 psig, reducing pressure of the feed gas liquid to form a pressure-reduced feed gas liquid;

using each of the feed gas vapor, the pressure-reduced feed gas liquid, and a vapor portion of a deethanizer overhead product to either provide cooling for a deethanizer overhead product in a second heat exchanger and the feed gas in a first heat exchanger whereby the pressure-reduced feed gas liquid is heated to a temperature between 20° F. to 90° F. in the second heat exchanger or to provide cooling for the deethanizer overhead product and the feed gas in a single heat exchanger;

combining the feed gas vapor with the vapor portion of the deethanizer overhead product after the vapor portion of the deethanizer overhead product has provided cooling for the deethanizer overhead product and the feed gas to thereby form a sales gas stream; and feeding the pressure-reduced feed gas liquid after having provided cooling for the deethanizer overhead product and the feed gas to a deethanizer to thereby produce the deethanizer overhead product and a C3+ bottom product, wherein the deethanizer is operated at a pressure between 250-400 psig.

2. The method of claim 1 wherein the feed gas is cooled and expanded to a pressure of between 500 to 700 psig and a temperature between −30° F. to −60° F.

3. The method of claim 1 further comprising a step expanding the feed gas vapor in a turboexpander.

4. The method of claim 3 wherein the step of reducing pressure of the feed gas liquid is performed in a JT valve.

5. The method of claim 1 wherein the feed gas vapor, the pressure-reduced feed gas liquid, and the vapor portion of the deethanizer overhead product are used to sequentially provide cooling for the deethanizer overhead product in the second heat exchanger and the feed gas in the first heat exchanger.

6. The method of claim 1 further comprising a step of separating the deethanizer overhead product to thereby form a reflux to the deethanizer and the vapor portion of the deethanizer overhead product.

7. The method of claim 6 wherein the reflux has a temperature between −30° F. to −60° F.

8. The method of claim 1 wherein the step of expanding the feed gas and reducing pressure of the feed gas liquid is performed in a device other than a turboexpander.

9. A gas processing plant, comprising a first heat exchanger and a first expansion device fluidly coupled to each other and configured to cool and expand a high-pressure feed gas having a pressure of at least 1000 psig to a temperature and pressure effective to condense a portion of the feed gas, thereby forming a two-phase stream comprising a feed gas liquid and a feed gas vapor;

a high-pressure phase separator fluidly coupled to the first expansion device and configured to separate the two-phase stream into the feed gas liquid and the feed gas vapor at a pressure between 600-700 psig;

a connection that is configured to fluidly couple the high-pressure separator to a conduit that carries a vapor portion of a deethanizer overhead product, and wherein the connection is configured to allow combination of the feed gas vapor with the vapor portion of the deethanizer overhead product after the vapor portion of the deethanizer overhead product has provided cooling for a deethanizer overhead product and the feed gas;

a second expansion device that is configured to receive and expand the feed gas liquid and to provide the expanded pressure-reduced feed gas liquid to at least one of the first heat exchanger and a second heat exchanger to thereby provide cooling for the deethanizer overhead product;

wherein the at least one of the first heat exchanger and the second heat exchanger are configured to use each of the feed gas vapor, the pressure-reduced feed gas liquid, and the vapor portion of a deethanizer overhead product to either provide cooling for the deethanizer overhead product in the second heat exchanger and the feed gas in the first heat exchanger whereby the pressure-reduced feed gas liquid is heated to a temperature between 20° F. to 90° F. in the second heat exchanger or to provide cooling for the deethanizer overhead product and the feed gas in the first heat exchanger; and a deethanizer that is configured to receive the expanded pressure-reduced feed gas liquid and to produce the deethanizer overhead product and a C3+ bottom product, wherein the deethanizer is configured to operate at a pressure between 250-400 psig.

10. The plant of claim 9 wherein the cooled and expanded feed gas has a pressure of between 500 to 700 psig and a temperature between −30° F. to −60° F.

11. The plant of claim 9 wherein the first heat exchanger is configured to cool the feed gas and wherein the second heat exchanger is configured to cool the deethanizer overhead product.

12. The plant of claim 9 further comprising an additional separator that is configured to separate cooled deethanizer overhead product to thereby form a reflux to the deethanizer and the portion of the deethanizer overhead product.

13. The plant of claim 12 wherein the reflux has a temperature between −30° F. to −60° F.

14. The plant of claim 9 wherein the first expansion device is a device other than a turboexpander.

15. The plant of claim 9 wherein the second expansion device is a device other than a turboexpander.

* * * * *